US008166694B2

(12) United States Patent
Swan

(10) Patent No.: US 8,166,694 B2
(45) Date of Patent: May 1, 2012

(54) FIREARM SECURING DEVICE AND METHOD

(75) Inventor: Johnny E. Swan, Virginia Beach, VA (US)

(73) Assignee: S&S Precision, LLC, Virginia Beach, VA (US)

( * ) Notice: Subject to any disclaimer, the term of this patent is extended or adjusted under 35 U.S.C. 154(b) by 144 days.

(21) Appl. No.: 12/386,539

(22) Filed: Apr. 20, 2009

(65) Prior Publication Data

US 2009/0293334 A1 Dec. 3, 2009

Related U.S. Application Data

(60) Provisional application No. 61/124,705, filed on Apr. 18, 2008.

(51) Int. Cl.
*F41C 33/04* (2006.01)

(52) U.S. Cl. ..... 42/90; 42/85; 42/106; 24/3.1; 224/198

(58) Field of Classification Search ..... 42/85, 90, 42/106; 24/3.1, 3.11, 3.12; 224/191, 913
See application file for complete search history.

(56) References Cited

U.S. PATENT DOCUMENTS

| | | | | |
|---|---|---|---|---|
| 1,107,040 | A | | 8/1914 | Conde |
| 1,610,092 | A | | 10/1924 | Hise |
| 2,236,736 | A | | 9/1938 | Scott |
| 2,296,287 | A | | 9/1942 | Leyde |
| 2,346,695 | A | | 4/1944 | Miller |
| 2,545,419 | A | | 3/1951 | Williams |
| 2,837,630 | A | | 6/1958 | Shen |
| 2,972,739 | A | | 2/1961 | Opper |
| 3,155,297 | A | | 11/1964 | Stumpf |
| 3,348,746 | A | | 10/1967 | Stumpf |
| 3,769,663 | A | | 11/1973 | Perl |
| 3,834,052 | A | | 9/1974 | Steck, III |
| 3,908,950 | A | | 9/1975 | Apel |
| 4,008,536 | A | | 2/1977 | Adams |
| 4,216,600 | A | | 8/1980 | Brueckner et al. |
| 4,504,001 | A | * | 3/1985 | Nichols ..... 224/198 |
| 4,750,656 | A | * | 6/1988 | Bianchi et al. ..... 224/673 |
| 4,777,754 | A | | 10/1988 | Reynolds, Jr. |
| 4,905,396 | A | | 3/1990 | Bechtel |
| 4,939,863 | A | | 7/1990 | Alexander et al. |
| 5,014,892 | A | | 5/1991 | Copeland |
| 5,018,653 | A | * | 5/1991 | Shoemaker ..... 224/198 |
| 5,033,219 | A | | 7/1991 | Johnson et al. |
| 5,040,322 | A | | 8/1991 | Iturrey, Jr. |
| 5,054,170 | A | | 10/1991 | Otrusina |
| 5,070,437 | A | | 12/1991 | Roberts, Sr. |
| 5,122,781 | A | | 6/1992 | Saubolle |
| 5,203,624 | A | | 4/1993 | Schier et al. |
| 5,265,781 | A | * | 11/1993 | Nichols ..... 224/198 |
| 5,400,008 | A | | 3/1995 | Toohey |
| 5,414,405 | A | | 5/1995 | Hogg et al. |
| 5,430,967 | A | | 7/1995 | Woodman, III et al. |
| 5,436,814 | A | | 7/1995 | Hanley |

(Continued)

*Primary Examiner* — Michael David
(74) *Attorney, Agent, or Firm* — Speed Law Firm

(57) ABSTRACT

Embodiments include a method and apparatus for removably connecting a firearm, accessory, or tool to a surface, material, object, belt, vehicle, pocket, or tactical equipment. The apparatus may include a first connecting member operatively connectible to the firearm, accessory, or tool and a second connecting member operatively connectible to the surface, material, object, belt, vehicle, pocket, or tactical equipment. The first connecting member and second connecting member are capable of connection to one another to connect the firearm, accessory, or tool to the surface, material, object, belt, vehicle, pocket, or tactical equipment.

20 Claims, 5 Drawing Sheets

U.S. PATENT DOCUMENTS 5,438,494 A 8/1995 Harlan
5,469,346 A 11/1995 Haut et al.
5,564,610 A * 10/1996 Barron ..... 224/268
5,598,958 A * 2/1997 Ryan et al. ..... 224/198
5,620,120 A 4/1997 Tien
5,622,297 A * 4/1997 Rogers et al. ..... 224/243
5,633,623 A 5/1997 Campman
5,671,561 A 9/1997 Johnson et al.
5,697,695 A 12/1997 Lin et al.
5,810,221 A * 9/1998 Beletsky et al. ..... 224/244
5,839,630 A * 11/1998 Dunstan et al. ..... 224/197
5,850,954 A 12/1998 Dong-Joo
5,865,524 A 2/1999 Campman
6,012,827 A 1/2000 Caplan et al.
6,059,156 A 5/2000 Lehtinen
6,067,013 A 5/2000 Pejic
6,069,557 A 5/2000 Anglin, Jr. et al.
6,112,448 A * 9/2000 Gray et al. ..... 42/94
6,161,741 A 12/2000 French
6,185,854 B1 2/2001 Solinsky et al.
6,190,018 B1 2/2001 Parsons et al.
6,213,623 B1 4/2001 Campman
6,276,088 B1 8/2001 Matthews et al.
6,371,625 B2 4/2002 Campman
6,393,752 B1 5/2002 Oliver et al.
6,478,441 B2 11/2002 Lam
6,499,245 B1 12/2002 Swan
6,578,311 B2 6/2003 Danielson et al.
6,616,294 B1 9/2003 Henry
6,685,067 B2 2/2004 French
6,742,913 B2 6/2004 Deutsch
6,785,997 B2 9/2004 Oz
6,817,727 B1 11/2004 McFadden
6,955,279 B1 * 10/2005 Mudd et al. ..... 224/197
6,976,777 B1 12/2005 Herold
7,021,790 B2 4/2006 Parsons
7,096,620 B2 8/2006 Zeh
7,156,536 B1 1/2007 McCorkle
7,195,370 B2 3/2007 Riblett et al.
7,218,241 B2 5/2007 Kessel et al.
7,226,183 B2 6/2007 Galli et al.
7,267,453 B2 9/2007 Chang et al.
7,287,873 B2 10/2007 Galli
7,395,627 B2 7/2008 La France et al.
7,444,776 B2 11/2008 Adams
7,458,489 B1 * 12/2008 Mudd et al. ..... 224/197
7,517,108 B2 4/2009 Galli et al.
7,523,583 B2 4/2009 Cheng
7,534,006 B2 5/2009 Goswami et al.
7,562,484 B2 7/2009 Kim
7,694,450 B2 4/2010 Keng
7,735,255 B1 * 6/2010 Kincaid et al. ..... 42/146
7,736,013 B2 6/2010 Griffin
7,743,547 B2 6/2010 Houde-Walter
7,827,724 B1 * 11/2010 Spinelli ..... 42/124
7,836,625 B2 11/2010 Swan et al.
2002/0096545 A1 7/2002 Chang
2002/0148865 A1 10/2002 French
2003/0090893 A1 5/2003 Nepil
2003/0098323 A1 5/2003 Taylor et al.
2003/0141329 A1 7/2003 Huang
2004/0000083 A1 1/2004 Grant, Jr.
2004/0069821 A1 4/2004 Kobayashi
2006/0026888 A1 2/2006 Cheng et al.
2006/0198132 A1 9/2006 Trigiani et al.
2006/0236583 A1 * 10/2006 Pikielny ..... 42/85
2007/0230162 A1 10/2007 Galli et al.
2008/0205037 A1 8/2008 Griffin
2009/0122527 A1 5/2009 Galli
2009/0185854 A1 * 7/2009 Adams ..... 403/322.1
2009/0190332 A1 7/2009 Sharrah
2010/0018103 A1 1/2010 Holmberg
2010/0128470 A1 5/2010 Swan et al.
2010/0192448 A1 * 8/2010 Darian ..... 42/84
2011/0032694 A1 2/2011 Swan

* cited by examiner

FIREARM SECURING DEVICE AND METHOD

CROSS-REFERENCE TO RELATED APPLICATIONS

This application claims benefit of U.S. provisional patent application Ser. No. 61/124,705, filed Apr. 18, 2008, which is herein incorporated by reference.

BACKGROUND OF THE INVENTION

1. Field of the Invention

Embodiments generally relate to the attachment of accessories to military and law enforcement tactical equipment, belts, vehicles, or other objects, surfaces, or materials. More particularly, some embodiments relate to the attachment or optional mounting of firearms or assault rifles onto tactical equipment, belts, vehicles, or other objects.

2. Description of the Related Art

The current popular method for attachment of an assault rifle onto tactical equipment is the use of nylon webbing as a sling. The sling is configured in such a manner that it creates a loop of webbing from the rifle at one point, around the individual and back to the rifle at the same point or other point depending on individual preference.

As the sling is a simple loop of material around the individual, it provides no real retention of the rifle during other activities that require the rifle to be out of the way and secure. When the weight of the rifle is solely loaded on the sling without the individual touching the rifle, the rifle is referred to as "slung". When the rifle is slung to the front position, side position, or the back of the body, it is not held in position by anything other than gravity tension on the sling and the lack of movement by the individual. If the individual were to climb, walk, run, bend over, or fall down, the rifle would move out of its intended position. Therefore, there exists a need to facilitate a convenient and secure attachment and detachment method of the rifle or other firearm and/or one or more accessories to tactical equipment, belts, vehicles, or other objects.

SUMMARY OF THE INVENTION

To this end, embodiments advantageously include a device or apparatus which provides for secure, convenient, fast, and easy attachment and/or detachment of a firearm, tool, and/or accessory to/from tactical equipment, objects, surfaces, or materials. Embodiments may further include the option of one-handed attachment and/or detachment of the firearm, tool, and/or accessory to/from tactical equipment, objects, surfaces, or materials.

Embodiments may advantageously provide attachment with positional security.

Embodiments generally include an apparatus for connecting a firearm to tactical equipment or a material or object, comprising a first connecting member operatively and fixedly attachable to the firearm; a second connecting member operatively and fixedly attachable to the tactical equipment or material or object, wherein the first connecting member and second connecting member are removably attachable to one another to connect the firearm to the tactical equipment or material or object. Embodiments may also include an apparatus for connecting a firearm to tactical equipment, a surface, or an object, comprising a clasping portion capable of fixing the apparatus horizontally to the firearm or a rail section attachable to the firearm or another object; a connector capable of fixing the apparatus vertically to the firearm or a rail section attachable to the firearm or another object; and a clipping portion capable of clipping the tactical equipment, surface, or object to the firearm, rail section, or other object.

Other embodiments may include a method of connecting a firearm to tactical equipment, comprising providing an apparatus having a first connecting member and a second connecting member; operatively connecting the first connecting member to a firearm or accessory, wherein the first connecting member is fixed in position along a length and width of the firearm or accessory; operatively connecting the second connecting member to tactical equipment or a surface or material, wherein the second connecting member is fixed in position along a length and width of the firearm or accessory; and connecting the first connecting member and second connecting member to one another, wherein the first connecting member and second connecting member are attachable and detachable from one another using one hand, wherein the first connecting member is operatively connected to the firearm or accessory using a clasping member to fix a width of the first connecting member and at least one first fastening member to fix a length of the first connecting member relative to the firearm or accessory; the second connecting member is operatively connected to the tactical equipment or surface or material using at least one second fastening member; and the first and second connecting member are connected to one another when a protruding mechanism in one of the connecting members cooperates with a slot in the other connecting member.

BRIEF DESCRIPTION OF THE DRAWINGS

So that the manner in which the above-recited features of embodiments can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
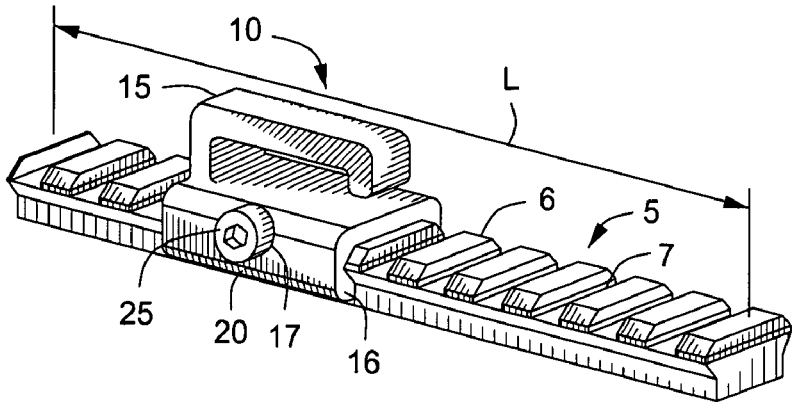
FIG. 1 is a side perspective view of a first embodiment of a WeaponLink™ apparatus operatively attached to a rail system.

Embodiments may include a platform herein referred to as a WeaponLink™ apparatus, for example as shown and described in FIGS. 1-10, which is capable of accepting one or more multiple optional accessories (i.e. one or more firearms, assault rifles, mechanical tools, quick detach pouches, etc.) from one surface of tactical equipment to another surface or piece of equipment at desired locations and with positional security. The WeaponLink™ apparatus may include slides, threaded holes, spindles, clips, spring loaded tension devices, and/or other mounting fixtures suitable for securing the one or more accessories to various surfaces or tactical equipment. The WeaponLink™ apparatus may be configured to present a relatively low-profile protrusion from tactical equipment using physical surfaces that offer low risk of snagging or becoming caught in external devices when accessories are not in place. Embodiments may allow for adjustment of the position of the accessories when they are attached to the WeaponLink™ apparatus, which desirably may accept more than one optional accessory. Advantageously, the WeaponLink™ apparatus permits the user to attach and/or detach the accessories to and/or from the tactical equipment surface or other surface using only one hand with positional security resulting upon attachment. Embodiments advantageously allow addition of the WeaponLink™ apparatus to already-manufactured rail systems, tactical equipment, and optional accessories.

Generally, the WeaponLink™ apparatus may employ one or more mechanisms that may grab and tension one or more surfaces of tactical equipment, e.g., the side and top surfaces of a standard M1913A rail system or any other rail or rail system known to those skilled in the art. In some embodiments, the WeaponLink™ apparatus accessory mount may be secured to the rail system using one or more existing through-holes with one or more threaded fasteners, rivets, nuts, bolts, and/or spring loaded balls or plunger type devices which may be made, for example, from plastic (for light duty applications), stainless steel, aluminum, and/or forge-hardened steel.

A benefit of embodiments is that the WeaponLink™ apparatus mount may be added to already-manufactured rail systems, tactical equipment, and/or optional accessories. If necessary, the female and male interface shape of the WeaponLink™ apparatus (which may, for example, be round), may be modified to a dovetail, square, or other shape to accommodate generally positive fixture stability depending on shape design and customer requirements.

The WeaponLink™ apparatus acts as a fastener of a firearm, tool, or other accessory to a user's belt, vehicle, tactical gear, or other object, material, or surface. In one embodiment, a first portion of the WeaponLink™ apparatus is attachable to the firearm, tool, or other accessory, and a second portion of the WeaponLink™ apparatus is attachable to the user's belt, vehicle, tactical gear, or other object, material, or surface. The first and second portions may be attachable to one another and removable from one another, e.g., by moving a protrusion through a slot or by screwing or unscrewing motion, and may be lockable into place with respect to one another when moved or screwed in relationship to one another. One of the portions of the firearm fastener WeaponLink™ apparatus may include a hole through which the other corresponding portion of the firearm fastener is moveable or screwable into the locked or unlocked position.

A first embodiment of the Weaponlink™ apparatus 10 is shown in FIG. 1. In this embodiment, the Weaponlink™ apparatus 10 may be a clip device. Depicted in FIG. 1 is a rail section 5 to which the apparatus 10 may be attachable. The rail section 5 may have ridges or raised portions 6 with spaced slots or cutouts 7 therebetween. In one embodiment, the rail section 5 is a M1913A Picatinny rail section, although the rail section 5 may instead be any type of rail section known to those skilled in the art. The rail section 5 may be attached to a firearm such as an assault rifle. The rail section 5 or rail may be a bracket connectable to a firearm for providing a standardized platform for mounting accessories thereto.

The apparatus 10 may include a connecting portion 20 which may be shaped to removably connect to the rail section 5, for example generally U-shaped. The generally U-shaped portion 20 of the apparatus 10 may include inward protrusions 16 on each bottom side (which is the top of the "U") which secure the apparatus 10 around the rail section 5. The distance between inner surfaces of the inward protrusions 16 may be less than the distance between inner surfaces of a portion of the U-shaped portion 20 to allow clasping of the apparatus 10 onto the rail section 5 while at the same time permitting movement of the apparatus 10 along the length L of the rail section 5.

One or more holes 17 through the portion 20 may accommodate one or more fastening members 25, e.g., one or more screws, bolts, and/or nuts. The one or more fastening members 25 may positionally secure the apparatus 10 to the rail section 5 at a location along the length L of the rail section 5. For example, screwing or inserting the fastening member(s) 25 into the hole(s) 17 may lock the apparatus 10 to the rail section 5 at a position along the length L of the rail section 5 and unscrewing or removing the fastening member(s) 25 from the hole(s) 17 may unlock the apparatus 10 from the rail section 5 to allow movement of the apparatus 10 relative to the rail section 5 lengthwise or longitudinally. The one or more fastening members 25 may include one or more threaded fasteners, rivets, nuts, bolts, cam-type devices, and/or spring loaded balls or plunger-type devices. The one or more fastening members 25 may be made from plastic (e.g., for light duty applications), stainless steel, aluminum, and/or forge-hardened steel. Of course, any other type of fastening member known to those skilled in the art made of any material known to those skilled in the art for constructing fastening members may be utilized in combination with or in lieu of the above-listed examples.

The apparatus 10 may include a clip portion 15 which is either molded to or operatively connected to the U-shaped portion 20. The clip portion 15 may be a clip-like protrusion which extends longitudinally with respect to the U-shaped portion 20. The clip portion 15 is preferably made of a material which stays in the position shown in FIG. 1 until sufficient force to move the clip portion 15 relative to the U-shaped portion 20 is exerted by a material or object inserted between the clip portion 15 and the U-shaped portion 20. The material or object may be, for example, one or more locations along the MOLLE (modular lightweight load-carrying equipment) system of a standard military tactical vest (e.g., nylon vest), a belt (e.g., along the waistline), a pocket (either attached or unattached to clothing), or other tactical equipment.

Figure 2:
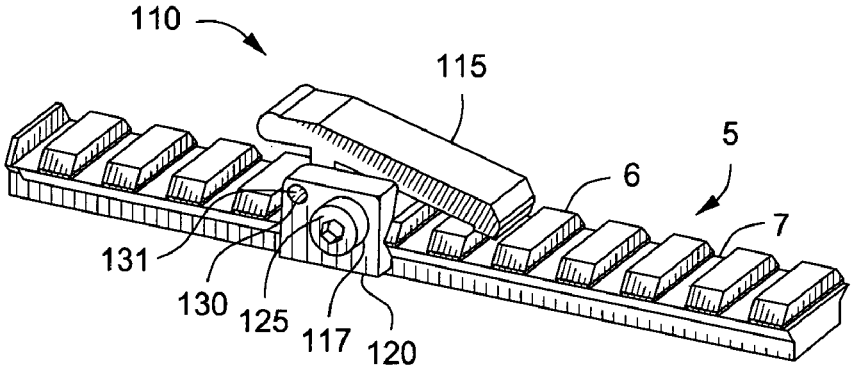
FIG. 2 is a side perspective view of a second embodiment of a WeaponLink™ apparatus operatively attached to a rail system.
Figure 3:
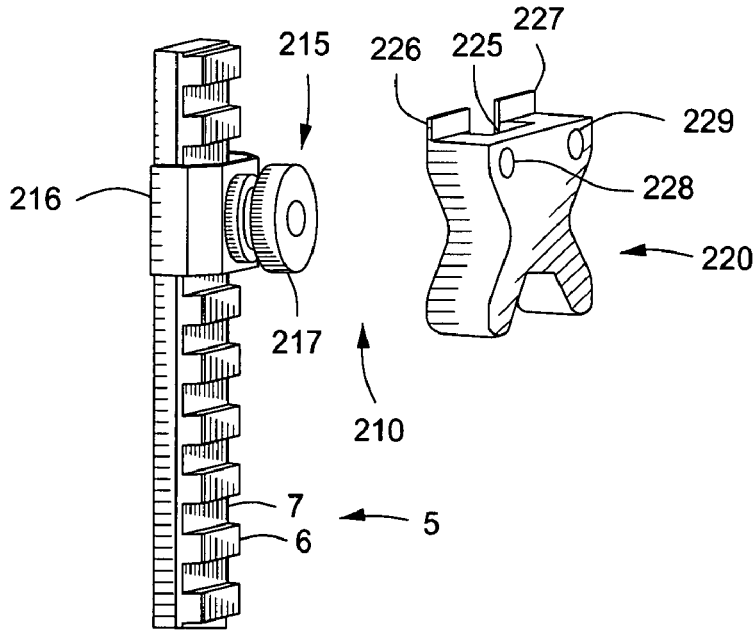
FIG. 3 is a side perspective view of a third embodiment of a WeaponLink™ apparatus operatively attached to a rail system.
Figure 4:
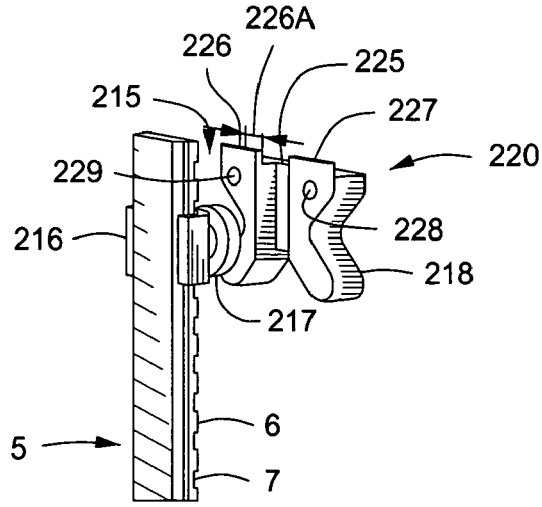
FIG. 4 is a bottom perspective view of the WeaponLink™ apparatus of FIG. 3.

In the embodiment shown in FIG. 2, the Weaponlink™ apparatus 110 may include a clip device with one or more spring tensioning members. The apparatus 110, which is shown operatively connected to the rail section 5 in FIG. 2, may include a connecting portion 120 similar to the connecting portion 20 shown and described with respect to the embodiment of FIG. 1. Also similar to the embodiment shown in FIG. 1, one or more holes 117 through the generally U-shaped portion 120 may accommodate one or more fastening members 125. Hole(s) 117 and fastening member(s) 125 are similar to the hole(s) 17 and fastening member(s) 25 shown and described with respect to FIG. 2.

Operatively attachable to the generally U-shaped portion 120 of the apparatus 110 is a clip portion 115. The clip portion 115 may be biased towards the rail section 5 via tension force of one or more springs or other tensioning devices (not shown). The clip portion 115 may include one or more extensions 131 from its width which are extendable through one or more additional holes 130 through the generally U-shaped portion 120. The one or more extensions 131 preferably include an extension 131 from each side of the clip portion 115, and the one or more holes 130 preferably include a hole in each side of the "U" of the U-shaped portion 120, where each respective extension 131 from each respective side extends through the hole 130 on its respective side.

The biasing force of the clip portion 115 may provide tension while the clip portion 115 is clipped on or tucked into the object or material which may be the same as the object or material to which the clip portion 115 is clipped as described above with respect to the embodiment of FIG. 1.

The above-described connection devices may be further secured with additional connection members, e.g., hardware such as magnetic force, spring tensioning devices, or gravity locking.

FIGS. 3-6 illustrate a third embodiment of the Weaponlink™ apparatus 210 which includes a male interface 215 and a female interface 220. The male interface 215 includes a connecting member 216 which is similar to the connecting portions 20 and 120 shown and described with respect to the embodiments of FIGS. 1-2; however, the connecting member 216 is shown as a separate piece from the remainder of the apparatus 210. Of course, it is within the scope of alternate embodiments that the connecting member 216 may be integral with or molded to any or all of the other pieces of the connecting member 216. The male interface 215 is attachable to the rail 5, e.g., via the connecting member 216 and its U shape engaging the rail within the "U."

Figure 5:
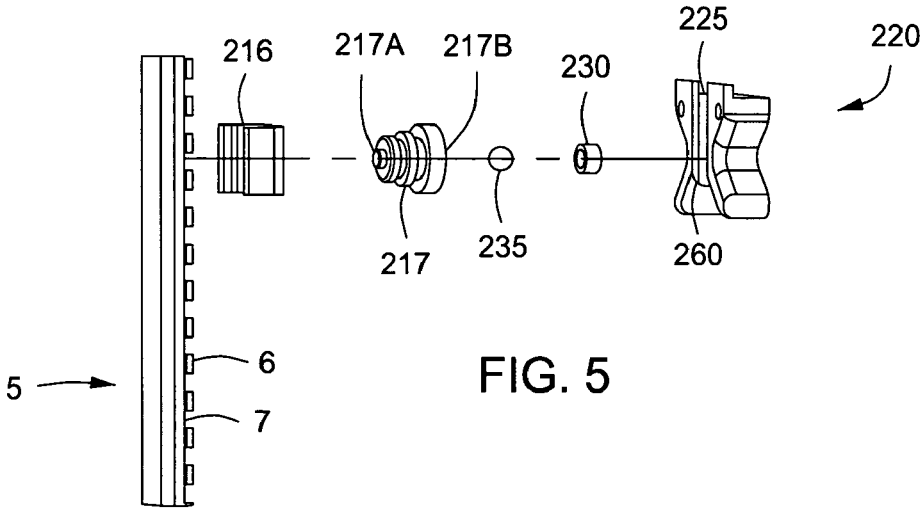
FIG. 5 is an exploded view of the WeaponLink™ apparatus of FIG. 3.
Figure 6:
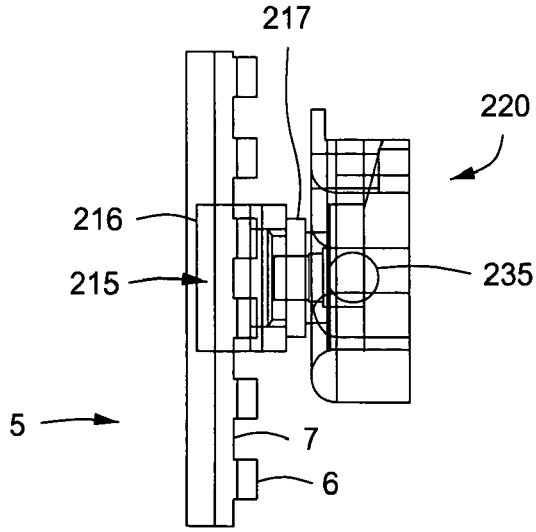
FIG. 6 is an assembled side view of the WeaponLink™ apparatus of FIG. 3.

As best illustrated in FIG. 5, the connecting member 216 and a connector 217 are operatively connected to one another, e.g., via threaded connection. In one embodiment, the connecting member 216 includes female threads therethrough which mate with male threads on the connector 217; however, any method or means of connection between the connecting member 216 and connector 217 which are known to those skilled in the art may be employed for use with embodiments.

Upon its placement on the rail 5, the U-shape with tabs of the connecting member 216 grabs the rail 5 (and is therefore sized in its width to fit the intended rail on which it will be utilized) along its horizontal axis, while the threaded male cylinder of the connector 217 places tension along the vertical axis by its insertion in the rail slot or cutout 7 (connector threaded mail cylinder is placed in between ridges or raised portions 6, which hold the cylinder in place vertically). In the embodiment shown, connector 217 is round at its first end 217A; however, the shape may be any shape capable of being retained within the slot 7 of the rail 5, including but not limited to dovetail, square, or any other shape capable of accommodating generally positive fixture stability depending on shape design and possible customer or user requirements.

A ball 235 may be placed in the second end 217B of the connector 217, and a retaining member 230 for the ball 235, such as a flange or nut, may be placed over the ball 235. The ball 235 and retaining member 230 may be molded or otherwise attached at or near the second end 217B of the connector 217. The ball 235 may instead be of any other shape known to those skilled in the art which is capable of forming an extension or protrusion from the male interface 215 for retention of the male interface 215 within the female interface 220 (see below).

The female interface 220 may include a receptacle 225 or channel or slot, which may be a cutout in the female interface 220. The receptacle 225 may be formed through a first side of the female interface 220 and terminate at a second side 218 of the female interface 220. Thus, the receptacle 225 is bounded by a first piece 226 of the first side, a second piece 227 of the first side, and a second side 218 of the female interface 220. The receptacle 225 is sized to allow at least a portion of the male interface 215 to slide along the receptacle 225 into an eventual friction fit with the female interface 220 via the boundaries of the receptacle 225 (see FIG. 6). To this end, shoulders 226A (shoulder of second piece 227 is not shown) from the first piece 226 and second piece 227 jut inward into the receptacle 225 to retain the female interface 215 within the receptacle when the female interface 215 is placed therein.

Optionally, an indention may be formed within the receptacle-facing portion of the second side 218 to permit secure retention and locking of the male and female interfaces 215, 220 to one another once the ball 235 reaches and enters the indention. The indention may be shaped to fit and retain the ball 235 therein.

One or more holes 228 and 229 may be formed through the female interface 220 for attaching the female interface 220 to one or more surfaces or mounting plates, for example via one or more screws, bolts, or other fastening members (not shown). In the embodiment shown in FIGS. 3-6, the female interface 220 is shaped similar to an "X" on its bottom half; however, any shape of the female interface is within the scope of embodiments, and embodiments are not limited to the shape depicted in the figures.

Figure 10:
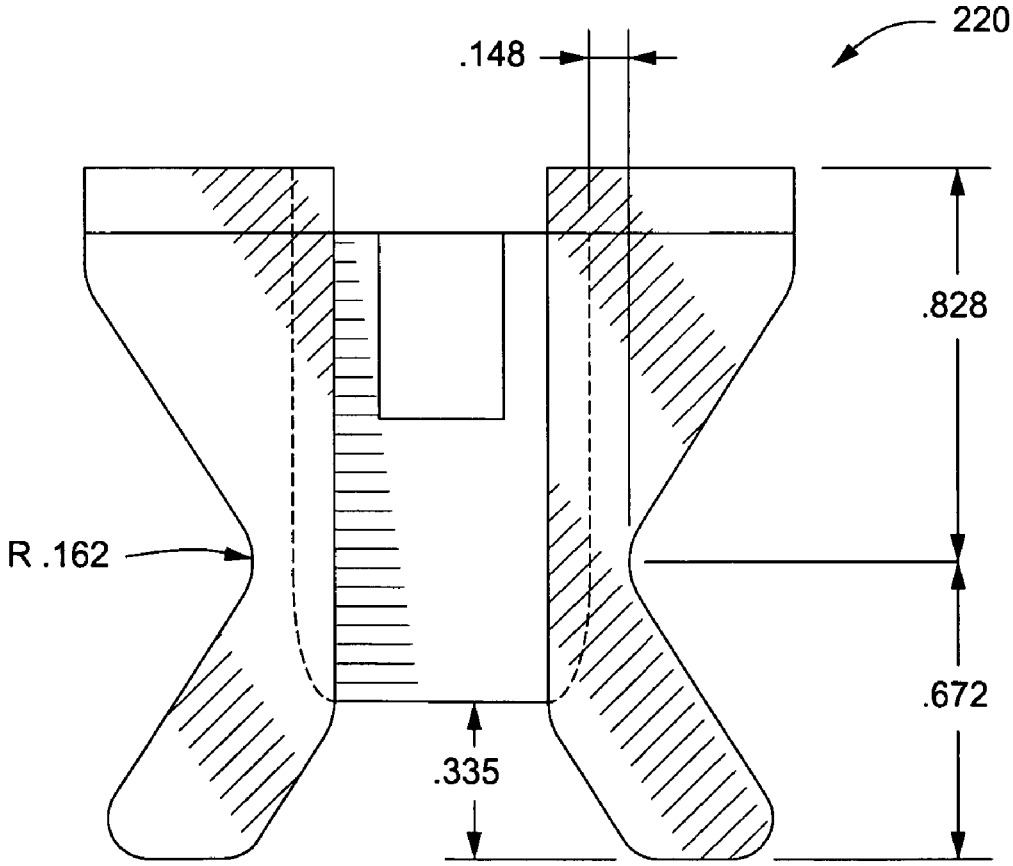
FIG. 10 is a downward view of the female member of the WeaponLink™ apparatus of FIG. 3.

FIG. 10 illustrates some exemplary dimensions (in approximate inches) of the female interface 220 shown and described with respect to FIGS. 3-6.

Figure 7A:
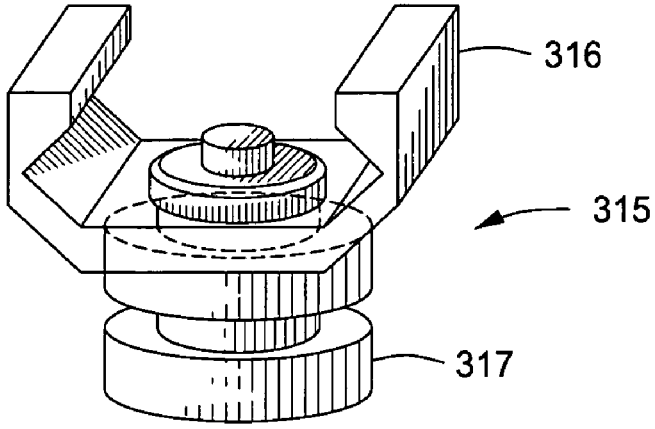
FIG. 7A is a perspective view of a male member of a fourth embodiment of a WeaponLink™ apparatus.
Figure 7B:
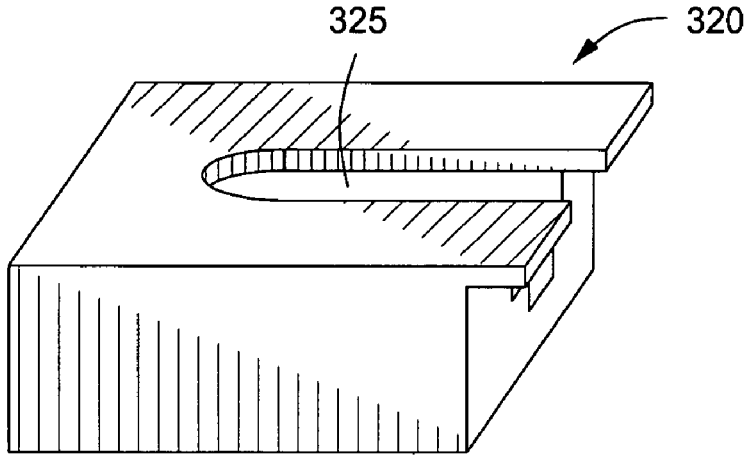
FIG. 7B is a perspective view of a female member of a fourth embodiment of a WeaponLink™ apparatus.

FIGS. 7A and 7B illustrate a fourth embodiment. FIG. 7A shows a male interface 315 which is the same as or similar to the male interface 215 shown and described with respect to FIGS. 3-6. The male interface 315 is capable of receiving a rail 5 or other accessories within the generally U-shaped portion of its connecting member 316. Its connector 317 is shaped to slide through a receptacle 325 of the female interface 320, which is shown in FIG. 7B. The female interface 320 of FIG. 7B is shown as generally rectangular-shaped, which is one of its possible shapes (but as mentioned above, any shape of the female interface 320 is contemplated as within the scope of embodiments).

Figure 9:
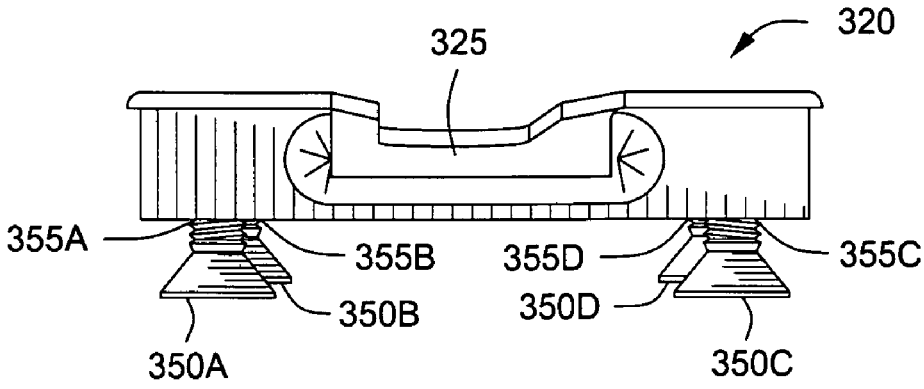
FIG. 9 is a side view of the female member of FIG. 7B.

FIG. 9 shows a front end view of the female interface 320 of FIG. 7B with fastening members 350A, 350B, 350C, and 350D within their respective holes 355A, 355B, 355C, and 355D through the female interface 320. The fastening members 350A, 350B, 350C, and 350D may be utilized to connect the female interface 320 to one or more surfaces or mounting plates. Of course, any number of holes and fastening members may be utilized for this purpose, including only one hole and fastening member, and the holes may be formed through any location on the female interface 320.

Figure 8:
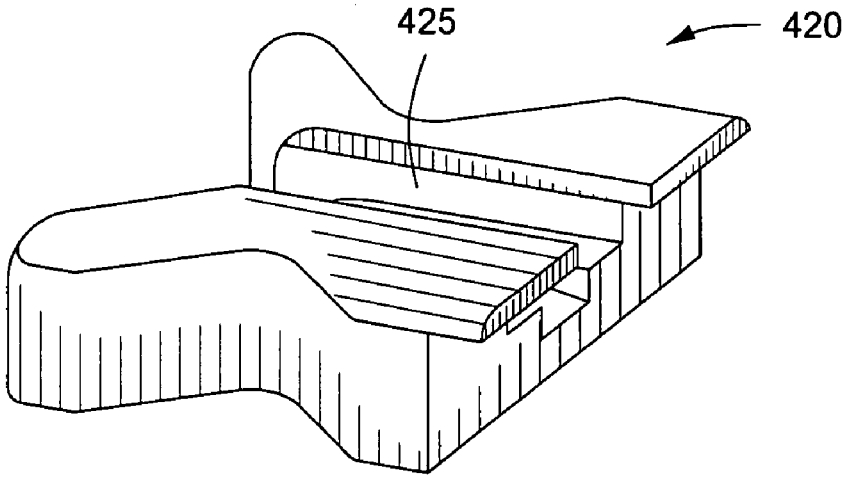
FIG. 8 is a perspective view of a female member of a fifth embodiment of a WeaponLink™ apparatus.

FIG. 8 illustrates an embodiment of the female interface 420 in another shape, with the receptacle 425 running therethrough. This female interface 420 may cooperate with the male interface 315, with the male interface 315 being connectable to the rail 5 or other accessory.

In an embodiment, the Weaponlink™ apparatus of FIGS. 3-9 may grab a rail (e.g., a standard M1913 rail system) along its horizontal axis and place tension along the vertical axis with a threaded male cylinder. In some embodiments, the Weaponlink™ apparatus rail mount may be secured to the rail system using existing through-holes with one or more fasteners (e.g., threaded fasteners), rivets, nuts, bolts, cam-type devices, and/or spring-loaded balls or plunger-type devices which may be constructed from, for example, plastic and/or metal such as stainless steel, aluminum, and/or forge-hardened steel, or any other material or fastener or connector known to those skilled in the art which is capable of securing objects to one another. This same threaded male cylinder may be responsible for providing the protrusion shape that will connect and lock into the female interface, which may be accomplished with the existing shape alone, or further tension to lock the male and female interfaces to one another may be provided by one or more magnet devices, spring-loaded balls, and/or plunger-type devices, or any other mechanisms known to those skilled in the art capable of connecting the interfaces to one another.

The female interface of embodiments provides a receptacle shaped to receive at least a portion of the male interface. The receptacle may be in the form of a pocket, groove, slot, notch, and/or slide, or any other type of receptacle capable of fitting a portion of the male interface therein to provide a connection between the two interfaces, and optionally further tension between the male and female interfaces may be applied using one or more magnets, spring-loaded balls, and/or plunger-type devices, or any other mechanisms known to those skilled in the art capable of connecting the interfaces to one another. In one embodiment, the female interface is designed to receive a variety of mounting plates which provide for mounting along various surfaces (e.g., MOLLE system, standard belt, wall surface, vehicle door, security locker, etc.).

In the embodiments described above, the Weaponlink™ apparatus is capable of connecting one or more accessories to one or more locations, surfaces, objects, and/or materials. The one or more accessories may for example include one or more of the following: rail, firearm (e.g., rifle or assault rifle), tool (e.g., mechanical tool), quick detach pouch. The one or more locations, surfaces, objects, and/or materials may for example include one or more of the following: mounting plate, tactical equipment, other equipment piece, belt, vehicle (e.g., a vehicle door), vest, location on a MOLLE system (e.g., of a standard military tactical nylon vest), pocket, along the waist line, wall surface, security locker. The one or more accessories may be attached to the connecting portion 20, 120 or male interface 215, 315, while the one or more locations, surfaces, objects, and/or materials may be attached to the clip portion 15, 115 or female interface 220, 320, 420. The male and female interfaces are then removably attachable to one another to attach the one or more accessories to the one or more locations, surfaces, objects, and/or materials via the male and female interfaces, while the connecting portion and clip portion may be removably attachable to one another or instead may be molded together to attach the one or more accessories to the one or more locations, surfaces, objects, and/or materials via the connecting portion and clip portion.

In operation, the Weaponlink™ apparatus 10 of FIG. 1 is secured to the rail 5 (or other accessory) by placing the accessory or rail 5 within the U-shape of the connecting portion 20 (thereby securing the Weaponlink™ apparatus 10 horizontally). The Weaponlink™ apparatus 10 is then secured vertically by the one or more fastening members 25, e.g., by inserting the one or more fastening members 25 through the holes 17 in the connecting portion 20. The one or more fastening members 25 may be inserted in one of the slots or cutouts 7. Thus, the fastening member 25 holds the apparatus 10 in position relative to the rail 5 because it is held in place by its boundaries of the bottom of the "U" of the fastening member 25 and the two raised portions 6 of the rail 5 beside the cutout 7, and the bottom of the "U" is positionally engaged by the inward extensions of the top of the "U" which at least partially wrap around the rail 5.

The rail 5 may be secured to a firearm. To secure the rail 5 to a location, surface, object, and/or material, the location, surface, object, and/or material is inserted between the clip portion 15 and the connecting portion 20. Therefore, the location, surface, object, and/or material is ultimately connected to the rail 5 and/or firearm via the apparatus 10.

To remove the location, surface, object, and/or material from the rail 5 or other accessory or firearm, the location, surface, object, and/or material may be removed from the clip portion 15. Additionally or instead, the connecting portion 20 may be removed from the rail 5 or other accessory or firearm.

In operation, the Weaponlink™ apparatus 110 of FIG. 2 is secured to the rail 5 (or other accessory) in the same way as the Weaponlink™ apparatus 10 of FIG. 1 is secured to the rail 5 (or other accessory), as described above. The location, surface, object, and/or material is ultimately connected to the rail 5 and/or firearm in the same way as described above with respect to the Weaponlink™ apparatus 10 of FIG. 1. In the embodiment of FIG. 2, the clip device 115 provides spring tensioning force on the location, surface, object, and/or material to maintain it within the apparatus 10. The location, surface, object, and/or material may be removed from the clip device 115 by counteracting the spring tension bias force.

In operation, the Weaponlink™ apparatus 210 of FIGS. 3-8 is secured to the rail 5 (or other accessory) by placing the accessory or rail 5 within the U-shape of the connecting member 216 of the male interface 215. The U-shape with tabs of the connecting member 216 grabs the rail 5 (and is therefore sized in its width to fit the intended rail on which it will be utilized) along its horizontal axis, thereby securing the apparatus 210 horizontally. The male connector 217, when placed in a hole through the bottom of the "U" (which is preferably sized to retain the mail connector 217 therein), rests within a cutout 7 of the rail 5 and may rest in between raised portions 6. Therefore, the connector 217 positionally maintains the male interface 215 vertically by its positioning between the raised portions 6 within the cutout 7.

The female interface 220 may be connected to a location, surface, object, and/or material, for example through a mounting plate (not shown) and/or through one or more fasteners disposed through holes 229. To connect the female interface 220 to the male interface 215, the male interface 215 is placed within the receptacle 225 of the female interface 220 at the open end of the receptacle 225. The male interface 215 then slides along the female interface 220 through the receptacle 225 until it abuts a shoulder 260 of the receptacle 225. The male and female interfaces 215, 220 may be temporarily locked relative to one another using the protrusion shape that will connect and lock into the female interface, which may be accomplished with the existing shape alone, or further tension to lock the male and female interfaces to one another may be provided by one or more magnet devices, spring-loaded balls, and/or plunger-type devices, or any other mechanisms known to those skilled in the art capable of connecting the interfaces to one another. Ultimately, the location, surface, object, and/or material is removably or releasably but securely connected to the one or more accessories via the apparatus 210.

To disconnect the male and female interfaces 215, 220 from one another, the male interface 215 slides along the receptacle 225 from the shoulder 260 in the direction of the open end of the receptacle 225 and slides through the open end of the receptacle 225.

The apparatus 210 may be easily removed from the rail 5, accessory, or firearm by removing male interface 215 therefrom, and/or the apparatus 210 may be easily removed from the location, surface, object, and/or material by disconnecting the location, surface, object, and/or material from the female interface 220 (e.g., by unscrewing or otherwise removing the one or more fastening members from the holes 229).

The other embodiments of the female interface 320, 420 as well as the other embodiment of the male interface 315 operate in the same way as described above with respect to the female interface 220 and male interface 215.

Figure 11:
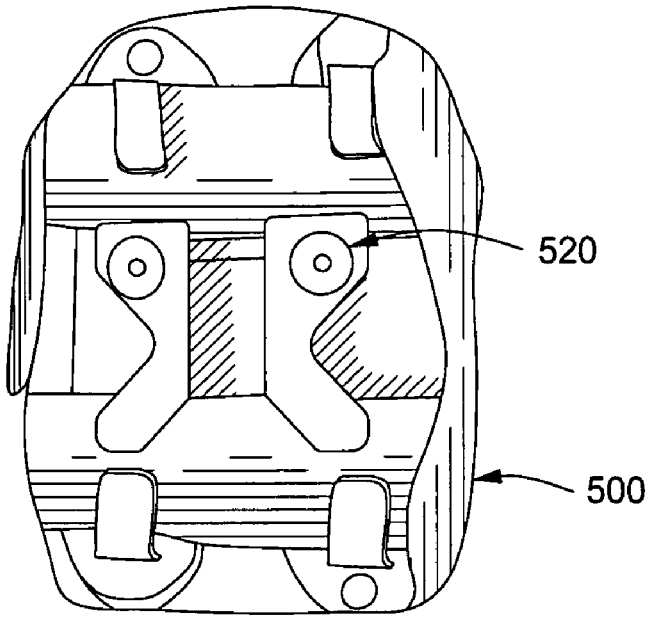
FIG. 11 is a view of a WeaponLink™ apparatus on a MOLLE system component.
Figure 12:
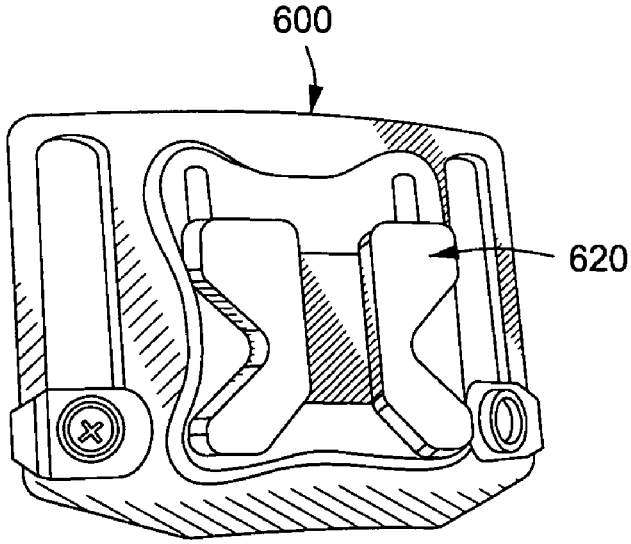
FIG. 12 is a view of a WeaponLink™ apparatus on a portion of a belt.

FIGS. 11 shows an embodiment of a Weaponlink™ apparatus 520 on a MOLLE version 500, and FIG. 12 shows an embodiment of a Weaponlink™ apparatus 620 on a portion of a belt 600. The Weaponlink™ apparatus 520 or 620 may include any of the embodiments shown and described herein in relation to FIGS. 1-10 or may instead have shown variations to the embodiments shown and described herein.

While the foregoing is directed to embodiments of the present invention, other and further embodiments of the invention may be devised without departing from the basic scope thereof, and the scope thereof is determined by the claims that follow.

The invention claimed is:

1. An apparatus for connecting a firearm to tactical equipment on a person's body or to clothing on a person's body, comprising:

a first connecting member operatively, fixedly, and directly attachable to the firearm or to a rail section of the firearm; and a second connecting member operatively and fixedly attachable to the tactical equipment on the person's body or to the clothing on the person's body, wherein:

the first connecting member and second connecting member are removably attachable to one another to connect the firearm to the tactical equipment on the person's body or to the clothing on the person's body, the first connecting member and second connecting member are attachable to one another using a male member extending from the first connecting member and a female member of the second connecting member, the male member and first connecting member acting together as one monolithic unit when attaching the first connecting member to the second connecting member, the female member is a slot in the second connecting member, the male member insertable in and moveable through the slot to attach the first connecting member and second connecting member to one another, and the first connecting member comprises the male member and a clasping member, the clasping member for operatively attaching the first connecting member to the firearm.

2. The apparatus of claim 1, wherein the clasping member operatively attaches to the first connecting member by attaching directly to the rail section which is fixedly attached to the firearm.

3. The apparatus of claim 2, wherein the clasping member is capable of securing the first connecting member relative to a width of the rail section and the male member is capable of securing the first connecting member relative to a length of the rail section.

4. The apparatus of claim 3, wherein the clasping member is capable of extending around and grabbing the rail section to secure the first connecting member relative to a width of the rail section.

5. The apparatus of claim 4, wherein the clasping member is generally U-shaped with protrusions extending inward from the ends of the general U shape to prevent movement of the first connecting member perpendicularly outward from the rail section.

6. The apparatus of claim 1, wherein the male member includes a protrusion which is capable of locking the male member into the female member upon insertion of the protrusion into a cutout in the slot.

7. The apparatus of claim 1, wherein the female member comprises a first surface with the slot therein and a second surface capable of connecting to one or more mounting plates for mounting the second connecting member to the tactical equipment on the person's body or to the clothing on the person's body.

8. The apparatus of claim 1, wherein the first connecting member is removable from the firearm for connection to another object or accessory.

9. The apparatus of claim 1, wherein the first connecting member and second connecting member are attachable and detachable from one another using one hand.

10. The apparatus of claim 1, wherein the second connecting member is fixedly attached to the tactical equipment on the person's body or to the clothing on the person's body.

11. An apparatus for connecting a firearm to tactical equipment or a material or object, comprising:

a first connecting member operatively and fixedly attachable to the firearm;

a second connecting member operatively and fixedly attachable to the tactical equipment or material or object, wherein:

the first connecting member and second connecting member are removably attachable to one another to connect the firearm to the tactical equipment or material or object, the first connecting member and second connecting member are attachable to one another using a male member extending from the first connecting member and a female member of the second connecting member, the female member is a slot in the second connecting member, the male member insertable in and moveable through the slot to attach the first connecting member and second connecting member to one another, the first connecting member comprises the male member and a clasping member, the clasping member for operatively attaching the first connecting member to the firearm, the clasping member operatively attaches to the first connecting member by attaching directly to a rail section which is fixedly attached to the firearm, the clasping member is capable of securing the first connecting member relative to a width of the rail section and the male member is capable of securing the first connecting member relative to a length of the rail section, and the male member secures the first connecting member to a first location on the rail section along its length when an opposite end portion of the male member from its end portion which is inserted into the female member is disposed within a cutout between raised portions of the rail section.

12. The apparatus of claim 11, wherein the first connecting member is moveable in position along the rail section and disposable within a second cutout of the rail section for connection to the rail section at a second location.

13. The apparatus of claim 11, wherein the clasping member is a grabbing member.

14. The apparatus of claim 11, wherein the male member is a threaded member and wherein rotation of the threaded member in one direction through a threaded hole through the clasping member positionally fixes the apparatus with respect to a length of the firearm or a rail section attachable to the firearm.

15. The apparatus of claim 11, wherein the clasping member is generally U-shaped for locating around and grabbing the firearm or rail section, and wherein ends of the "U" of the U-shaped clasping member comprise inward-extending protrusions for wrapping around and grabbing the firearm or rail section.

16. The apparatus of claim 11, wherein the clasping member further comprises a hole therethrough for receiving the male member therein to positionally fix the apparatus with respect to a length of the firearm or a rail section attachable to the firearm.

17. An apparatus for connecting a firearm to tactical equipment on a person's body or to clothing on a person's body, comprising:

a grabbing member capable of positionally fixing the apparatus with respect to a width of the firearm or a rail section attachable to the firearm;

a connector extending from the grabbing member which is capable of positionally fixing the apparatus with respect to a length of the firearm or a rail section attachable to the firearm; and a connecting member operatively and fixedly attachable to the tactical equipment on the person's body or to the clothing on the person's body, wherein:

the grabbing member and the connecting member are removably attachable to one another using the connector and a slot in the connecting member to connect the firearm to the tactical equipment on the person's body or to the clothing on the person's body, the connector and the grabbing member act together as one monolithic unit when attaching the grabbing member to the connecting member, and the connector is insertable in and moveable through the slot to attach the grabbing member and the connecting member to one another.

18. The apparatus of claim 17, wherein the connector is a threaded member and wherein rotation of the threaded member in one direction through a threaded hole through the grabbing member positionally fixes the apparatus with respect to a length of the firearm or a rail section attachable to the firearm.

19. The apparatus of claim 17, wherein the grabbing member is generally U-shaped for locating around and grabbing the firearm or rail section, and wherein ends of the "U" of the U-shaped grabbing member comprise inward-extending protrusions for wrapping around and grabbing the firearm or rail section.

20. The apparatus of claim 19, wherein the grabbing member further comprises a hole therethrough for receiving the connector therein to positionally fix the apparatus with respect to a length of the firearm or a rail section attachable to the firearm.

* * * * *